United States Patent [19]

Adams

[11] Patent Number: 4,903,450

[45] Date of Patent: Feb. 27, 1990

[54] CONCRETE FOOTER BLOCK AND FOUNDATION SYSTEM FORMED THEREFROM

[75] Inventor: Fred H. Adams, Cary, N.C.

[73] Assignee: Adams Products Company, Morrisville, N.C.

[21] Appl. No.: 347,000

[22] Filed: May 2, 1989

[51] Int. Cl.[4] ..... E02D 27/01

[52] U.S. Cl. ..... 52/293; 52/600; 52/605

[58] Field of Search ..... 52/293, 294, 295, 605, 52/606, 609, 604, 292, 586, 600

[56] References Cited

U.S. PATENT DOCUMENTS

| | | | |
|---|---|---|---|
| 1,375,103 | 4/1921 | Needham | 52/439 X |
| 1,690,259 | 11/1928 | Strauss . | |
| 1,765,664 | 6/1930 | Flath . | |
| 1,794,467 | 3/1931 | Lucas . | |
| 2,176,986 | 10/1939 | Briscoe | 52/293 |
| 2,200,636 | 5/1940 | Palmer | 189/1 |
| 2,329,585 | 9/1943 | Brewer | 52/293 X |
| 2,411,477 | 11/1946 | Straight | 52/586 X |
| 3,066,449 | 12/1962 | Cramer, Jr. | 50/185 |
| 3,226,935 | 4/1966 | Schneller | 61/49 |
| 3,826,052 | 7/1974 | Tenorio | 52/293 |
| 3,848,377 | 11/1974 | Mori | 52/169 |
| 3,956,859 | 5/1976 | Ingestrom | 52/169 R |
| 4,186,160 | 1/1980 | Landreth | 264/34 |
| 4,703,599 | 11/1987 | Pardo | 52/293 |
| 4,798,036 | 1/1989 | Pardo | 52/293 |

FOREIGN PATENT DOCUMENTS

| | | | |
|---|---|---|---|
| 2203824 | 8/1973 | Fed. Rep. of Germany | 52/606 |
| 0204226 | 11/1983 | Japan | 52/292 |

OTHER PUBLICATIONS

Publication by *Masonry Assocation* entitled "Get Off the Ground Fast with Interlocking Concrete Masonry Units", date unknown.

*Primary Examiner*—David A. Scherbel
*Assistant Examiner*—Jerrold D. Johnson
*Attorney, Agent, or Firm*—Richard E. Jenkins

[57] ABSTRACT

A concrete footer block and foundation system formed therefrom for a concrete block wall is provided and comprises a plurality of elongate concrete masonry footer blocks positioned in side-to-side abutting relationship along an axis parallel to the concrete wall to be supported by the foundation system. The footer blocks include an enlarged triangular cavity therein which extends across the footer block and downwardly into at least the middle portion of the block. The cavity is open on each side of the block as well as at the top surface thereof and has a bottom surface which is parallel to the bottom surface of the footer block and includes a plurality of spaced-apart first support ribs extending across the block and at least one second support rib extending perpendicularly to the first support ribs and parallel to the lengthwise direction of the footer block for supporting, respectively, reinforcement wire and reinforcement rods thereon in spaced-apart relation from the bottom surface of the cavity.

20 Claims, 7 Drawing Sheets

CONCRETE FOOTER BLOCK AND FOUNDATION SYSTEM FORMED THEREFROM

TECHNICAL FIELD

The present invention relates to concrete masonry block wall and building construction, and more particularly relates to an improved concrete footer block and concrete masonry footer block foundation system formed therefrom.

BACKGROUND ART

The footings for masonry-type structures such as small buildings and residential housing have been conventionally constructed by digging trenches in the soil according to the layout of the structure, forming wood frames for the footing in the trenches, and then pouring concrete into the space defined by the framing so as to form a continuous concrete tooting upon which the structure can be built. The purpose of this type of footing is to achieve two basic objectives: (1) to minimize total settlement of the structure built on the footing; and (2) to minimize differential settlement between different portions of a structure built on the footing. It is well known that since all footings will settle to some degree, an ideal design is one which provides sufficient resistance to deformation, distributes load forces over large soil areas, and permits uniform settlement of the footing.

The shortcoming of conventional cast-in-place concrete footings for supporting buildings and houses is that the footings are designed so as to be extremely rigid in an attempt to provide uniform pressure on the underlying soil. This requires the aforementioned expensive form work, good site access by concrete trucks and related equipment, and a substantial time for proper curing of the poured concrete footings.

In view of the known shortcomings to the traditional cast-in-place concrete footings, the concept of footings constructed of prefabricated segments was introduced in Europe after World War II due to an urgent need for speed and simplicity in the construction of buildings in order to expedite the post-war reconstruction. This type of prefabricated footing proved viable in Europe and during the years since the war has resulted in a number of prefabricated concrete block systems which are widely known both in Europe and in the United States. A common attribute of many of these prefabricated foundation systems is the use of interlocking blocks of relatively great weight which in some cases require special equipment on-site for placement of the blocks into the desired foundation system.

One interesting prefabricated foundation system is described in U.S. Pat. Nos. 4,703,599 and 4,798,036 assigned to the National Concrete Masonry Association. This system is known commercially as the IDR Footer Block System and comprises individual elongated footer blocks with interlocking side surfaces which are placed in side-by-side abutting relationship without the need for form work or concrete between the individual units. Shallow slots are provided in the top of the individual footer blocks so as to provide a nesting place for reinforcement wire which is placed on top of the foundation wall formed by the footer block foundation system. The reinforcement wire (wire trusses or Rebar) is then covered with a mortar leveling bed upon which the first foundation wall concrete masonry block course is placed. The IDR Footer Block System provides a fast and economical foundation system but does not possess the inherent strength of applicant's footer block system described hereinafter since the individual block units are reinforced only at the top surface thereof with the aforementioned wire reinforcement and mortar leveling bed.

DISCLOSURE OF THE INVENTION

In accordance with the present invention, applicant provides an improved concrete footer block and improved foundation system formed therefrom designed specifically to serve as a foundation for residential and light commercial buildings. The foundation system of the invention comprises a plurality of elongate concrete masonry footer blocks which are disposed in side-to-side abutting relationship along a footing axis which is substantially parallel to the concrete wall to be supported by the footing system. The novel footer blocks define a cavity therein which extends transversely to the longitudinal axis of the block and downwardly at least into the medial portion thereof, and the cavity is open at the top and on each side of the footer block. The cavity has a bottom surface plane substantially parallel to the bottom surface plane of the footer block and includes a plurality of spaced-apart ribs extending across the bottom surface of the cavity transversely to the lengthwise axis of the footer block for supporting metal reinforcing wire (or plastic grid or cloth) thereon. The cavity also includes at least one rib extending across the bottom surface thereof substantially perpendicular to the spaced-apart ribs and parallel to the lengthwise axis of the footer block for supporting one or more metal reinforcement rods (or plastic rods) in a plurality of spaced-apart recesses provided therein. After the foundation system is constructed of the aforementioned footer blocks and the reinforcement wire and/or reinforcement rods are positioned within the continuous cavity extending around the foundation which is formed by the cavities of abutting blocks, the continuous cavity is filled with grout so as to totally surround the reinforcement wire and/or metal reinforcement rods therein with grout as well as to form a concrete key interlock between the medial portions of abutting footer blocks. The foundation is thus rendered inherently stronger than previously known footer block foundations by virtue of the joining together of the grout filled cavities of abutting blocks as well as the reinforcement wire and/or metal reinforcement rods extending through the cavities and between adjacent blocks. The necessity for complex protrusions and recesses in order to form interlocking block surfaces is obviated while a yet stronger concrete footer block foundation system is provided. Also, in the alternative, the continuous cavity may be filled after a concrete masonry block wall is stacked on the foundation by pouring grout into the top of the completed wall so that both the foundation cavity and the wall cavities are filled with grout.

It is therefore an object of the present invention to provide an improved prefabricated concrete masonry footer block which is of a simple and lightweight construction for ease of handling and placement.

It is another object of the present invention to provide an improved prefabricated concrete masonry footer block which does not require a complex system of protrusions and recesses on the sides thereof in order to form an interlocking relationship with abutting footer blocks.

It is yet another object of the present invention to provide an improved prefabricated concrete masonry footer block and foundation system formed therefrom which is both simpler and inherently stronger than any footer block or foundation system formed therefrom known heretofore.

Some of the objects of the invention having been stated, other objects will become evident as the description proceeds, when taken in connection with the accompanying drawings.

BEST MODE FOR CARRYING OUT THE INVENTION

In order to fully appreciate the advancement of applicant's concrete footer block and foundation system formed therefrom over the related art, applicant would first like to recount the basic advantages of concrete masonry unit footings over conventional cast-in-place concrete foundations. First of all, as is known to those familiar with the prefabricated concrete footer block foundation art, concrete masonry footing units can be produced in highly sophisticated manufacturing facilities under carefully controlled conditions to ensure uniform quality among the units. All footings units must meet or exceed rigid strength and dimensional tolerance requirements as set forth in standards promulgated by the American Society for Testing and Materials (ASTM) whereas cast-in-place concrete foundations are subject to the effect of such variables as the amount of mixing water, mixing time, aggregate segregation, ambient temperature, method of concrete placement and curing. Any of these variables, either singularly or in combination with others, can adversely affect the strength, durability and overall quality of the cast-in-place concrete foundation. Significantly, the effect of these aforementioned variables can only be determined after the fact when it may be too late to easily correct any problems which may develop.

By contrast, construction of prefabricated masonry unit footings can begin as soon as the site excavation is completed. This is especially important where accessibility to the residential or commercial building site by large, heavy concrete trucks is restricted by adverse weather conditions. Still further, worker coordination problems are minimized with prefabricated masonry unit footings since unskilled labor may be utilized to place the footing units or, alternatively, the same building crew which constructs the concrete masonry block foundation walls can also be used to construct the foundation. Finally, the use of prefabricated masonry unit footings eliminates costly delays normally encountered with cast-in-place concrete foundations in waiting for the concrete to cure adequately before the construction of concrete block masonry foundation walls thereon may begin. As is known to those in the building trade, the use of concrete masonry footing units in lieu of cast-in-place concrete foundations can actually reduce labor requirements for comparable foundations by up to 50% and consequently significantly reduce overall construction cost.

Figure 1:
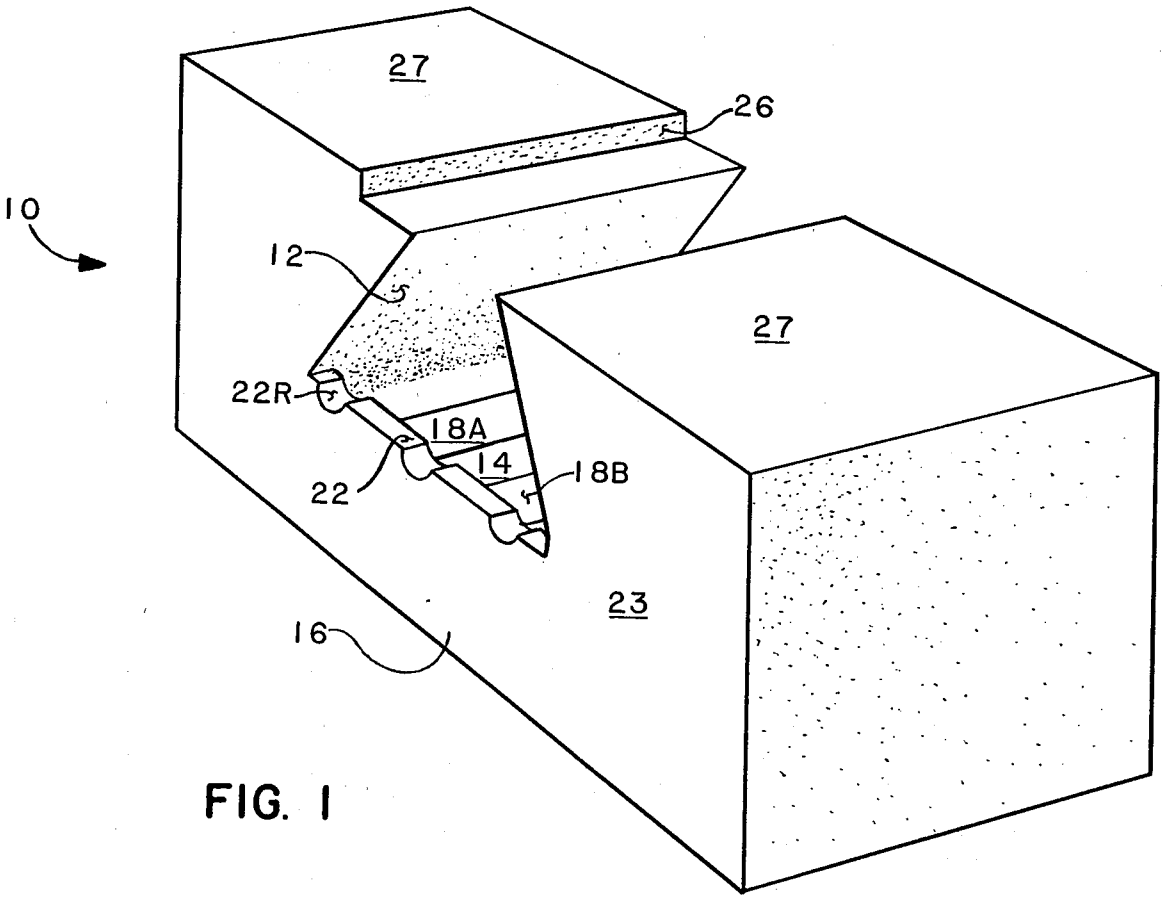
FIG. 1 is a perspective view of a footer block constructed according to the invention.
Figure 2:
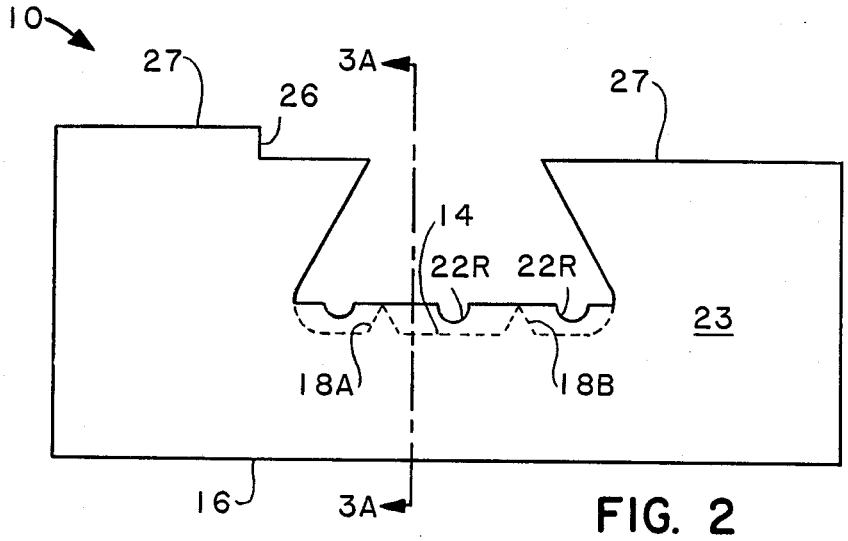
FIG. 2 is a side elevation of a footer block constructed according to the invention.
Figure 3:
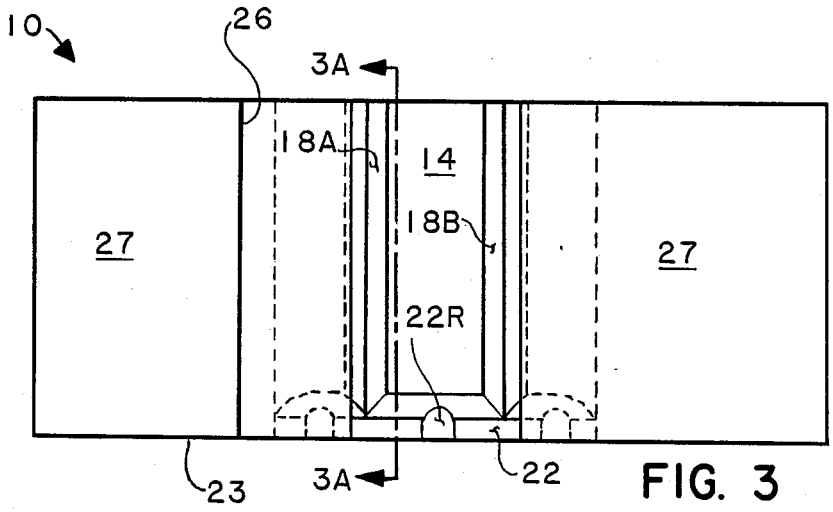
FIG. 3 is a top plan view of a footer block constructed according to the present invention.
Figure 3A:
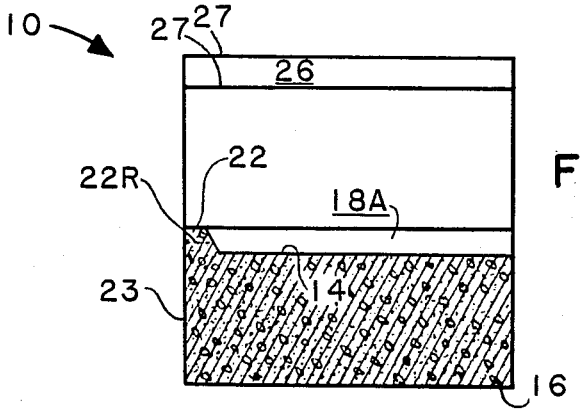
FIG. 3A is a vertical cross sectional view taken along lines 3A—3A of FIG. 2.

With the aforementioned generic advantages of prefabricated footing units fully understood, applicant would now like to refer in detail to the improved footer block and foundation system formed therefrom of the present invention. With particular reference now to the drawings in which like numerals and letters indicate like parts throughout FIGS. 1–9, FIG. 1 first illustrates a concrete footer block constructed in accordance with the present invention and generally designated 10. Footer block 10 is a concrete masonry block formed with a large triangular cavity 12 in the medial portion thereof which extends transversely across the block and is open at each end as well as at the top thereof. Cavity 12 extends downwardly and outwardly into at least the middle portion of footer block 10 and defines a bottom surface 14 which is parallel to the bottom surface 16 of footer block 10. Two spaced-apart and parallel support ribs 18A, 18B extend across bottom surface 14 of cavity 12 transverse to the lengthwise direction of footer block 10 and serve to support a reinforcement wire (or plastic wire or cloth) 20 (see FIGS. 4 and 5) thereon in spaced-apart relationship from cavity bottom surface 14. Although two support ribs 18A, 18B are depicted in the drawings, applicant contemplates that a plurality of any suitable number of support ribs can be utilized in footer block 10. Also, a support rib 22 (see FIG. 3A) is provided on cavity bottom surface 14 which extends perpendicularly to ribs 18A, 18B and generally parallel to the lengthwise direction of footer block 10 and adjacent to side 23 thereof for supporting metal reinforcement rods (or plastic rods) 24 (such as Rebar rods) in spaced-apart relationship above cavity floor 14. Rib 22 includes recesses 22R along the top thereof for snugly receiving metal reinforcement rods 24 (see FIGS. 4 and 5) therein and supporting the same above the bottom surface 14 of triangular cavity 12. Although only single rib 22 adjacent one end of cavity 14 is shown in the drawings, applicant contemplates that additional ribs may be utilized to support metal reinforcement rods extending through cavity 14 as a matter of design choice. Also, although applicant contemplates that both ribs 18A, 18B and 22 would be utilized in the preferred embodiment of footer block 10, it is possible to utilize only rib 22 to support reinforcement wire 20 and/or rods 24 thereon within cavity 12.

Figure 4:
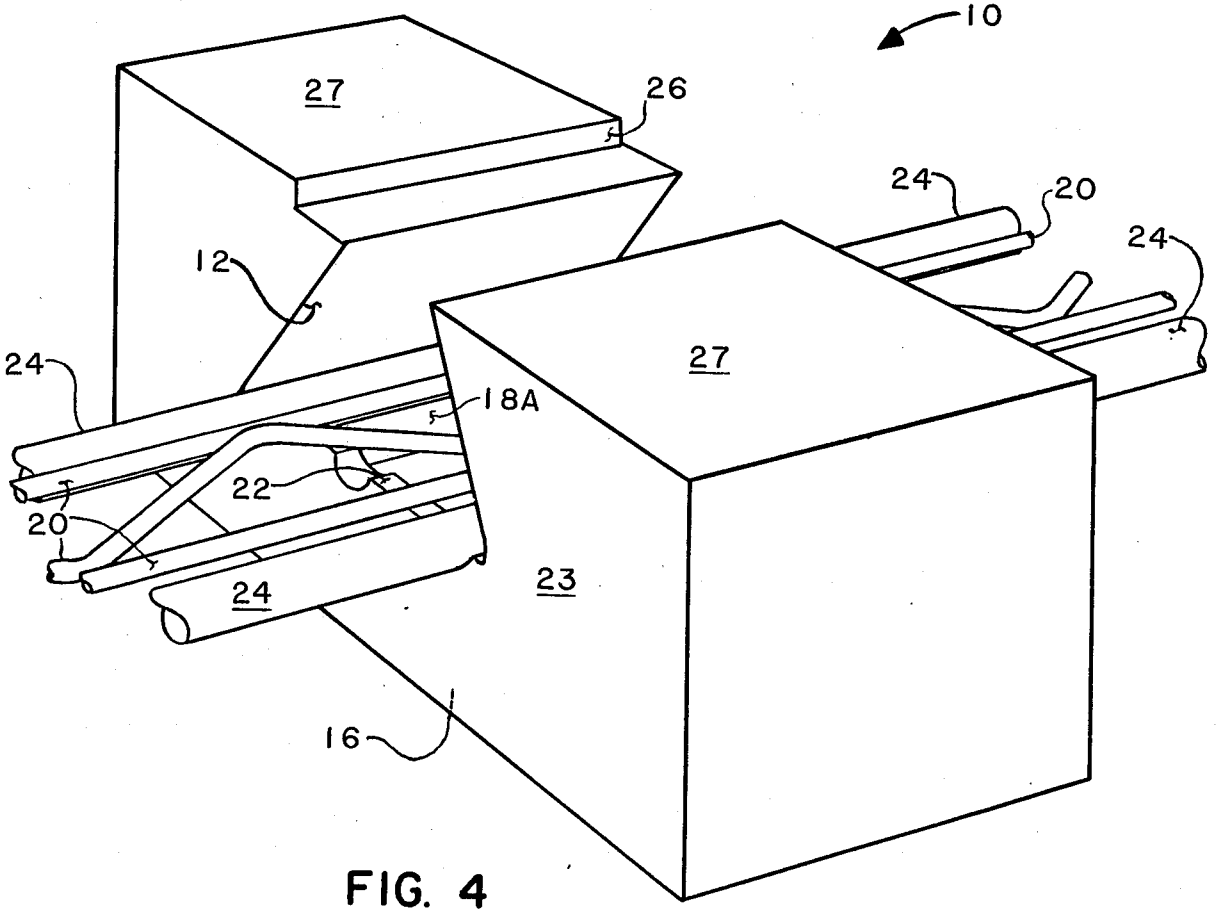
FIG. 4 is a perspective view of a footer block constructed according to the present invention with both metal reinforcement rods (Rebar) and reinforcement wire positioned therein and prior to the cavity being filled with grout.
Figure 5:
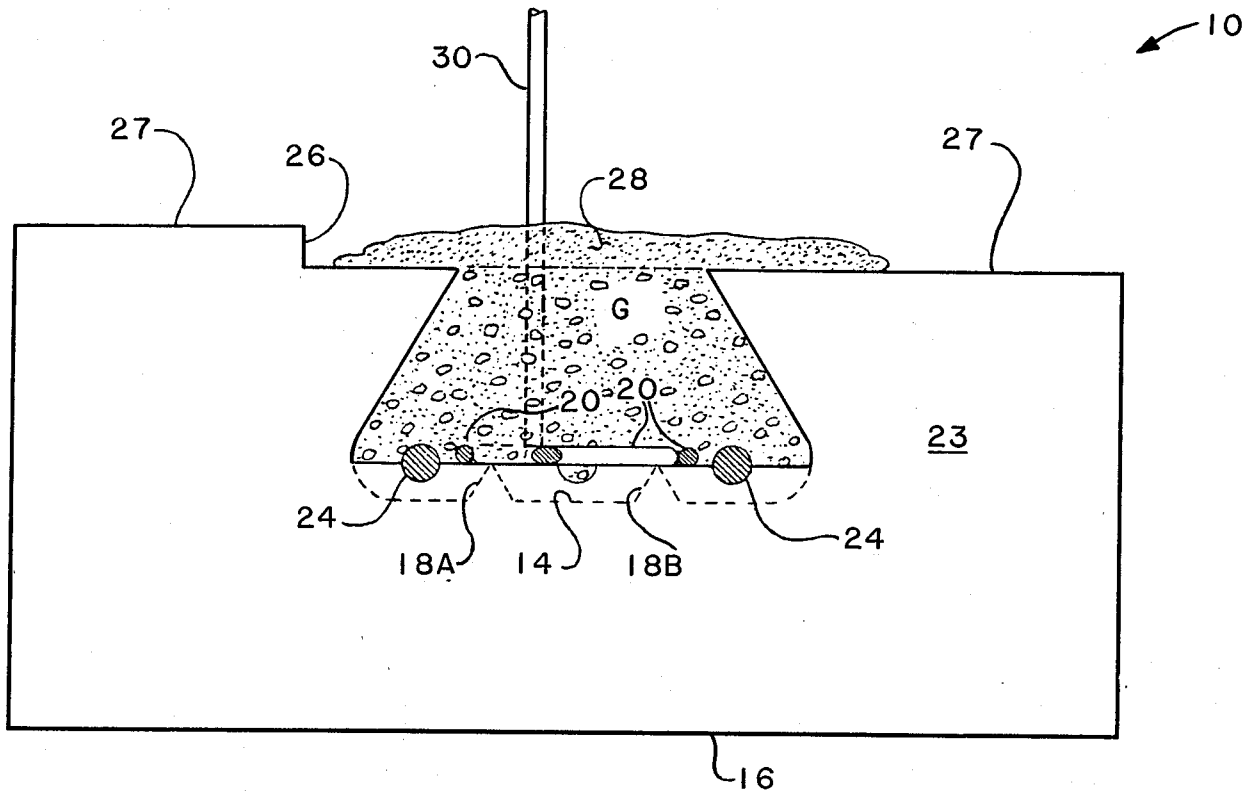
FIG. 5 is a side elevation view of a footer block constructed according to the invention with both the Rebar and reinforcement wire positioned in the cavity of the block which has been filled with grout.

Thus, when footer blocks 10 are placed in side-by-side abutting relationship along a footing axis which is substantially parallel to a concrete masonry block wall to be placed thereon they form a continuous cavity extending along the length of the foundation system and which is adapted to receive longitudinally extending reinforcement wire 20 and/or metal reinforcement rods 24 therein which are supported on ribs 18A, 18B and/or rib 22, respectively (see FIGS. 4 and 5). Once the reinforcement wire 20 and, if appropriate, metal reinforcement rods 24 are properly positioned within triangular cavity 12 of individual footer blocks 10 so as to each extend through a plurality of the blocks, the cavities 12 forming the continuous foundation cavity may be filled with grout G (see FIG. 5) which will surround and fully bond to reinforcement wire 20 and metal reinforcement rods 24 therein as well as form an interlocking key between abutting footer blocks 10. The size and shape of cavity 12 of footer block 10 permits sufficient grouting material to be accommodated by each footer block 10 to provide a particularly strong interlocking key between abutting footer blocks which further serves to structurally tie all footer blocks 10 together into a high strength foundation system. In the alternative, as noted above in the disclosure of the invention, a concrete masonry block wall may be first stacked (without cement) on top of the foundation system prior to filling the cavity, and grout then poured into the top of the completed wall so that both the foundation cavity and wall cavities are filled with grout.

With particular reference to FIGS. 1–5, footer block 10 can be seen to also include a shoulder 26 formed on top surface 27 proximate to one end thereof and adjacent the opening of triangular cavity 12. The ridge of shoulder 26 extends transversely to the lengthwise axis of footer block 10 so as to aid in proper straight line placement of concrete masonry block thereacross in order to stack a straight concrete block wall on the footer block foundation. Shoulder 26 and triangular cavity 12 are positioned within footer block 10 so as to permit use of 6 inch, 8 inch, 10 inch or 12 inch wide concrete masonry blocks thereon for forming a concrete block wall.

Although it is contemplated that footer block 10 may be constructed according to a wide variety of dimensions with a triangular profile cavity (in the lengthwise direction of the footer block) also formed according to a wide variety of dimensions, the following specifications serve as an illustrative example of a suitable block:

FOOTER BLOCK EXAMPLE 1

Length: 15 and $\frac{5}{8}$ inches

Height (including shoulder): 7 and $\frac{5}{8}$ inches

Height (excluding shoulder): 7 inches

Height of shoulder: $\frac{5}{8}$ inches

Width: 7 and $\frac{5}{8}$ inches

Width of cavity opening at top of footer block in lengthwise direction: 2 and $\frac{7}{8}$ inches Vertical depth of cavity: 4 and $\frac{3}{8}$ inches Width of cavity at bottom in lengthwise direction of footer block: 4 and $\frac{3}{8}$ inches Height of two (2) reinforcement wire support ribs: $\frac{3}{4}$ inches Height of one (1) reinforcement rod support rib: $\frac{3}{4}$ inches Minimum ultimate compressive strength: 1500 pounds per square inch Ultimate shear strength: 42.6 pounds per square inch Minimum ultimate tensile strength: 135 pounds per square inch Minimum ultimate compressive strength of footer block when filled with grout: 2,000 pounds per square inch

FOUNDATION SYSTEM CONSTRUCTION

To build a foundation system according to the present invention, the base for footer blocks 10 should be undisturbed soil at least 12 inches below the frost line at the construction site or as otherwise required by local building regulations. The earth base should be free of uncompacted fills, debris, mud or snow prior to the installation of footer blocks 10. If required, neatly cut footing steps may be formed in 8 inch high increments no closer than every 48 inches along the length of the foundation, and in all cases the soil at the bottom of the excavation must be level. Small level variations (plus or minus $\frac{1}{2}$ inch) may be adjusted with compacted granular material or with mortar. Larger adjustments (plus or minus 3 inches) must be made with compacted pea gravel or lean concrete. The top surface 27 of footer blocks 10 may be considered level so long as they are within plus or minus $\frac{3}{4}$ inches.

Figure 6:
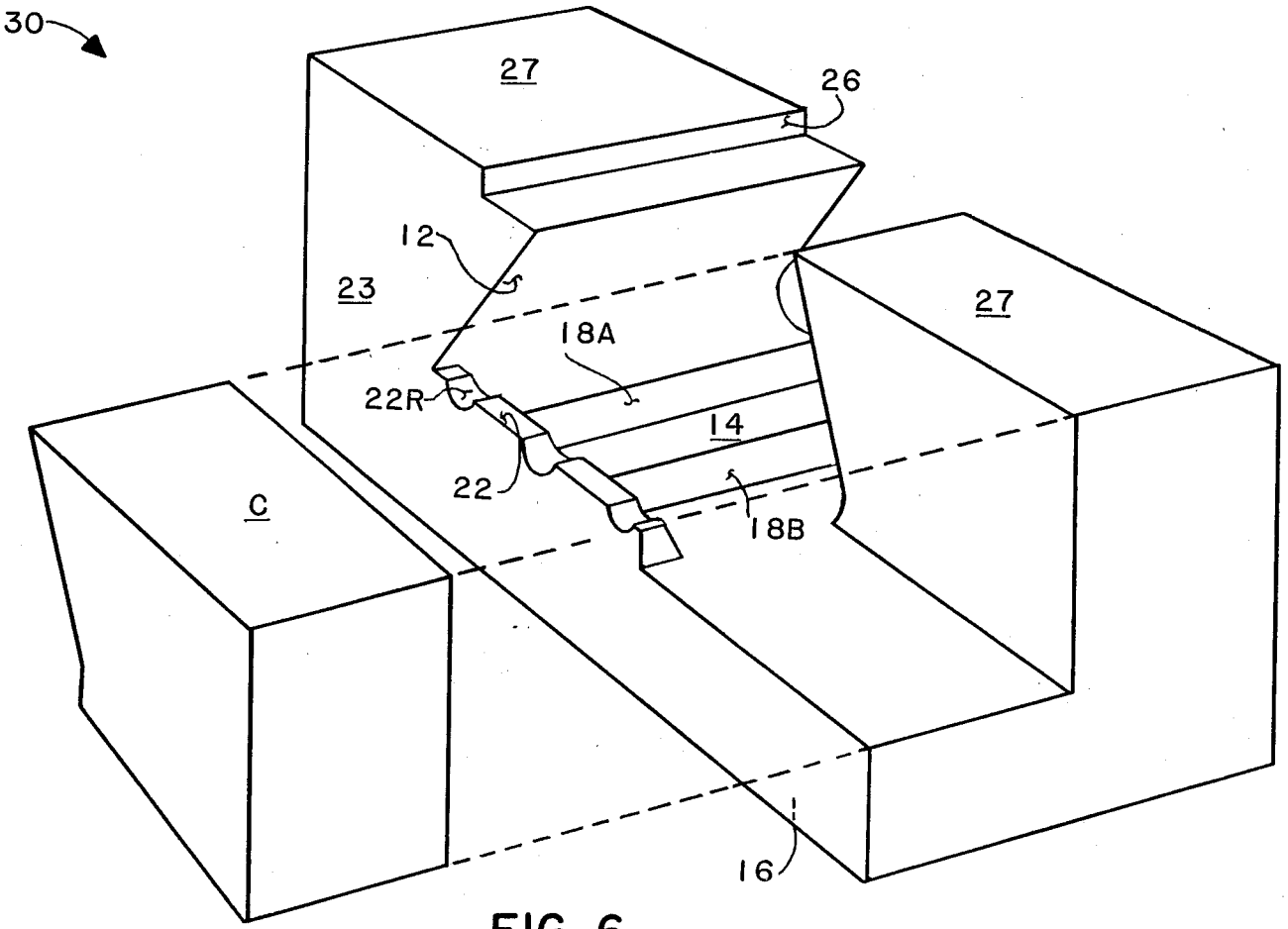
FIG. 6 is a perspective view of a footer block according to the present invention with a top corner portion removed by saw cut to facilitate construction of a corner in the foundation system formed from the novel footer blocks.
Figure 7:
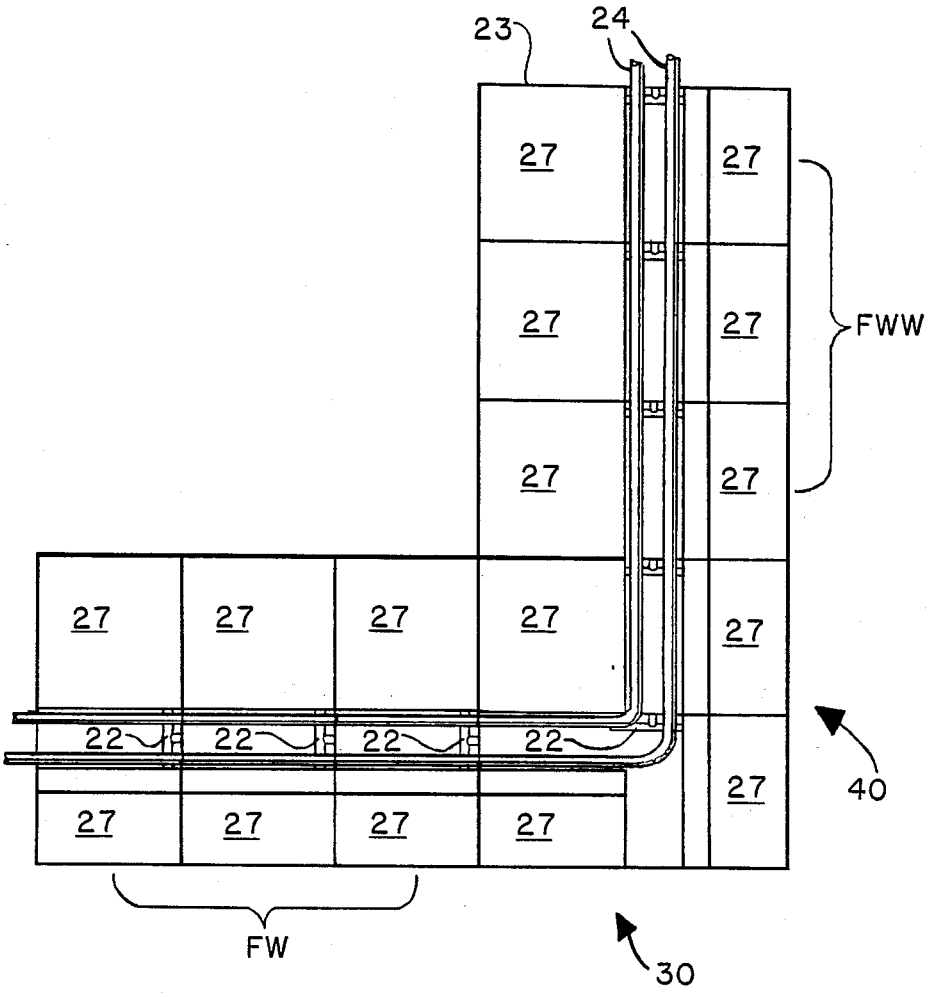
FIG. 7 is a top plan view of corner in a foundation system formed from footer blocks constructed according to the invention.

During installation, foundation dimensions must be verified as well as the wall angle prior to erecting a line set 4 inches outside of the actual foundation wall dimensions (which should be plus or minus $\frac{1}{2}$ inches in a 40 foot length). Then, the corner block units are laid and leveled when constructing a foundation system utilizing the footer blocks of the invention. With particular reference now to FIGS. 6 and 7, it can be appreciated that to form a corner unit the top corner portion C of footer block 30 is saw cut (or machine made) and removed down approximately to the level of the bottom 14 of cavity 12 (see FIG. 6) so as to form a conduit into cavity 12 where the corner previously existed. With reference to FIG. 7, it can be seen that the saw cut footer block 30 is turned 90 degrees relative to adjacent foundation wall FW of side-to-side abutting footer blocks and the removed corner serves as a continuation of the continuous cavity formed by the abutting blocks in adjacent walls FW and FWW which are joined at the corner. A second footer block 40 is placed adjacent the modified footer block to form the two footer block corner (which would normally be laid and leveled prior to the connection of walls FW and FWW thereto which form the foundation walls extending from the two corner footer blocks). The blocks in wall FWW are laid parallel to the two corner footer blocks as can be seen in FIG. 7. Normally, mortar would not be used between the individual footer blocks forming the foundation walls nor between the corner blocks. Once the reinforcement wire 20 and/or metal reinforcement rods 24 are placed onto block ribs 18A, 18B and/or ribs 22, respectively, within the continuous cavity defined by the foundation system constructed of footer blocks 10, the cavity may be filled with grout to surround and encase reinforcement wire 20 and/or metal reinforcement rods 24 as well as to form an interconnecting key between abutting footer blocks. Finally, the top surfaces 27 of footer blocks 10 are covered with a full mortar bed 28 to the width of the wall to be placed thereon which is utilized as final leveling for the first course of concrete masonry blocks of the concrete wall BW to be stacked on the foundation and then filled with grout (see FIG. 5). In the alternative, the blocks may be stacked on the foundation (without cement) prior to filling the cavity with grout and, after wall BW is completed, grout is poured into the top thereof so as to fill both the foundation and concrete block wall cavities with grout at the same time (see FIG. 8).

Figure 8:
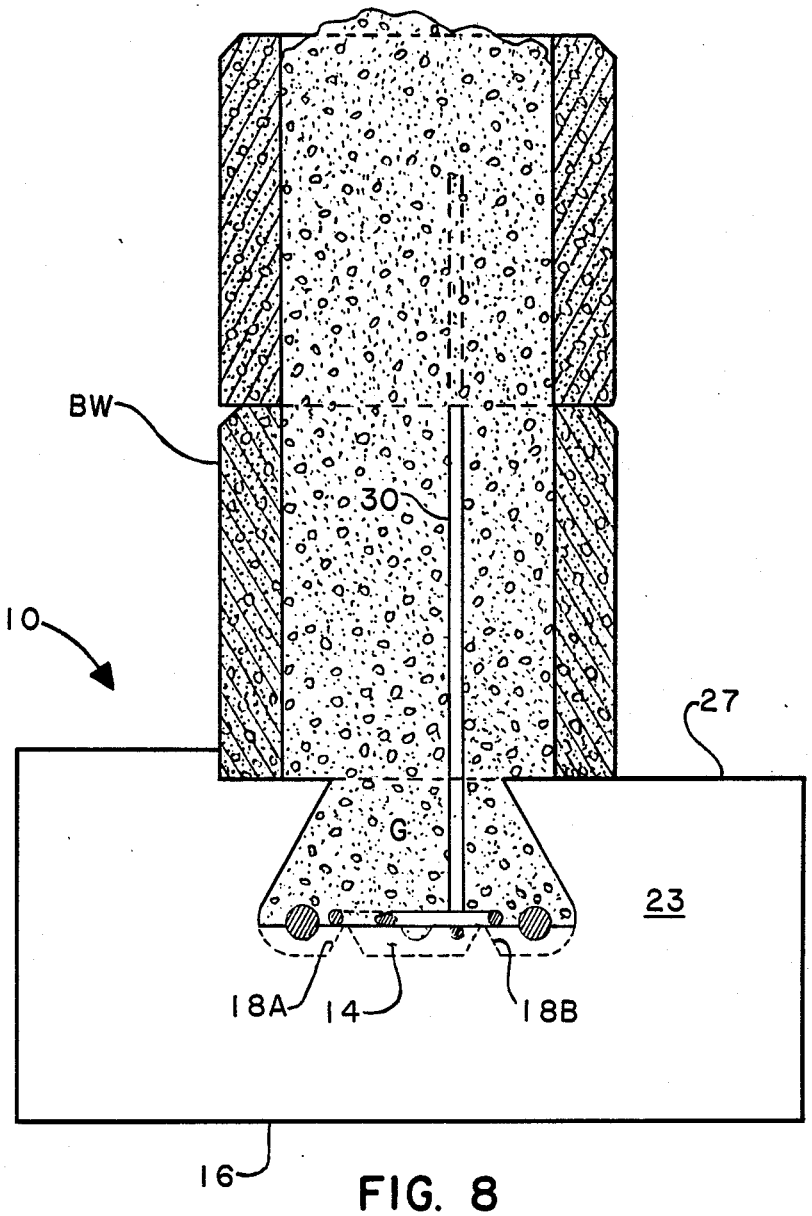
FIG. 8 is a vertical cross-section view of a foundation system constructed according to the present invention with a concrete masonry block wall stacked thereon.

As can also be seen with reference to FIG. 8, vertical reinforcement rods 30 (for example, Rebar) may optionally be periodically positioned in cavity 12 of selected footer blocks 10 so as to extend upwardly within cavities in concrete block wall BW stacked on footer blocks 10. Regardless of whether the cavity of the foundation is filled with grout before or after concrete block wall BW is stacked thereon, vertical rods 30 would be placed into position with the lower end hooked under reinforcement wire 30 and/or rods 24 before wall BW is filled with grout.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced by the claims.

What is claimed is:

1. A concrete wall and foundation system for a building, comprising:

a footing system including a plurality of elongate concrete masonry footer blocks comprising top, bottom and side surfaces and disposed in side-to-side abutting relationship along a footing axis which is substantially parallel to the concrete wall to be supported by said footing system, wherein said footer blocks each define a cavity therein which extends transversely to the longitudinal axis of the block and downwardly at least into the medial portion of the block, said cavity being open at the top surface and on each side surface of the footer block and having a bottom surface substantially parallel to the bottom surface of said footer block, and said footer blocks each including at least one support means extending across at least a portion of the bottom surface of said cavity substantially parallel to the longitudinal axis of said footer block for supporting one or more reinforcement elements thereon, and wherein said footer blocks further each define a shoulder on the top surface thereof proximate to the opening of said cavity and extending transversely to the longitudinal axis of said footer block to facilitate alignment of a concrete wall thereon; and a concrete wall being formed from concrete building blocks supported on said abutting footer blocks and stacked thereon adjacent the shoulders thereof so as to define said concrete wall.

2. A concrete wall and foundation system according to claim 1 wherein said at least one support means comprises a rib.

3. A concrete wall and foundation system according to claim 2 wherein said rib includes a plurality of recesses therein for snugly receiving one or more reinforcement elements therein.

4. A concrete wall and foundation system according to claim 1 wherein said footer blocks further include a plurality of spaced-apart support means extending across the bottom surface of said cavity transversely to the longitudinal axis of the footer block for supporting one or more reinforcement elements thereon.

5. A concrete wall and foundation system according to claim 4 wherein said plurality of spaced-apart support means comprises a plurality of ribs.

6. A concrete wall and foundation system according to claim 1 wherein said footer block is about 15 and $\frac{5}{8}$ inches long, about 7 and $\frac{5}{8}$ inches high and about 7 and $\frac{5}{8}$ inches wide.

7. A concrete wall and foundation system according to claim 1 wherein the cavity in said footer block has a triangular profile in the lengthwise direction of said block with the bottom surface thereof being substantially larger than the opening at the top of said footer block.

8. A concrete wall and foundation system according to claim 7 wherein the triangular profile cavity of said footer block has a depth of about 4 and $\frac{3}{8}$ inches, an opening width of about 2 and $\frac{7}{8}$ inches and a bottom width of about 4 and $\frac{3}{8}$ inches in a footer block measuring about 15 and $\frac{5}{8}$ inches in length, 7 and $\frac{5}{8}$ inches in height and 7 and $\frac{5}{8}$ inches in width.

9. A concrete wall and foundation system according to claim 1 wherein said concrete building blocks for said concrete wall are stacked transversely across said plurality of side-to-side abutting footer blocks.

10. A concrete wall and foundation system according to claim 9 wherein said concrete building wall blocks for said concrete wall are between about 6 to 12 inches in width.

11. A concrete wall and foundation system according to claim 1 wherein said shoulder of said footer block has a height of about $\frac{5}{8}$ inches on a footer block measuring about 15 and $\frac{5}{8}$ inches in length, 7 and $\frac{5}{8}$ inches in height including said shoulder and 7 and $\frac{5}{8}$ inches in width.

12. A concrete masonry footer block for forming a foundation system for a concrete masonry block wall comprising:

an elongate concrete masonry block comprising top, bottom and side surfaces and defining a cavity therein which extends transversely to the lengthwise direction of said block and downwardly at least into the medial portion thereof, said cavity being open at the top surface and on each side surface of said block and having a bottom surface substantially parallel to the bottom surface of said block, and said footer blocks each including at least one support means extending across at least a portion of the bottom surface of said cavity substantially parallel to the lengthwise direction of said block for supporting one or more reinforcement elements thereon, and wherein said footer blocks further each define a shoulder on the top surface thereof proximate to the opening of said cavity and extending transversely to the longitudinal axis of said footer block to facilitate alignment of a concrete masonry block wall thereon;

whereby said blocks may be placed in side-by-side abutting relationship with said cavities aligned so as to form a continuous cavity parallel to the concrete block wall to be constructed thereon and reinforcement elements placed in said block cavities on said support means so as to extend lengthwise with the continuous cavity, said aligned cavities when filled with grout forming a high strength interlocking footer block foundation wherein said reinforcement elements are surrounded by said grout for better bonding and enhanced foundation strength and said grout in said block cavities forms an interlocking key between abutting blocks.

13. A concrete masonry footer block according to claim 12 wherein said at least one support means comprises a rib.

14. A concrete masonry footer block according to claim 13 wherein said rib includes a plurality of recesses therein for snugly receiving one or more respective reinforcement elements therein.

15. A concrete masonry footer block according to claim 12 wherein said footer block further includes a plurality of spaced-apart support means extending across the bottom surface of said cavity transversely to the lengthwise direction of said block for supporting one or more reinforcement elements thereon.

16. A concrete masonry footer block according to claim 15 wherein said plurality of spaced-apart support means comprises a plurality of ribs.

17. A concrete masonry footer block according to claim 12 wherein said footer block is about 15 and $\frac{5}{8}$ inches long, about 7 and $\frac{5}{8}$ inches high and about 7 and $\frac{5}{8}$ inches wide.

18. A concrete masonry footer block according to claim 12 wherein the cavity in said block has a triangular profile in the lengthwise direction of said block with the bottom surface thereof being substantially larger than the opening thereof at the top of said footer block.

19. A concrete masonry footer block according to claim 18 wherein the triangular profile cavity of said block has a depth of about 4 and $\frac{3}{8}$ inches, an opening width of about 2 and $\frac{7}{8}$ inches and a bottom width of about 4 and $\frac{3}{8}$ inches in a footer block measuring about 15 and $\frac{5}{8}$ inches in length, about 7 and $\frac{5}{8}$ inches in height and about 7 and $\frac{5}{8}$ inches in width.

20. A concrete masonry footer block according to claim 11 wherein said shoulder of said block has a height of about $\frac{5}{8}$ inches on a footer block measuring about 15 and $\frac{5}{8}$ inches in length, 7 and $\frac{5}{8}$ inches in height including said shoulder and 7 and $\frac{5}{8}$ inches in width.

* * * * *